US005622301A

United States Patent [19]

Blum

[11] Patent Number: 5,622,301

[45] Date of Patent: Apr. 22, 1997

[54] CONCEALED BELT-MOUNTED VALUABLES HOLDER

[76] Inventor: Alvin S. Blum, 2350 Del Mar Pl., Fort Lauderdale, Fla. 33301

[21] Appl. No.: 424,515

[22] PCT Filed: May 11, 1994

[86] PCT No.: PCT/US94/04972

§ 371 Date: May 25, 1995

§ 102(e) Date: May 25, 1995

[87] PCT Pub. No.: WO94/27464

PCT Pub. Date: Dec. 8, 1994

Related U.S. Application Data

[63] Continuation-in-part of Ser. No. 69,746, Jun. 1, 1993, Pat. No. 5,337,936.

[51] Int. Cl.[6] ..... B65D 37/00

[52] U.S. Cl. ..... 224/587; 224/660; 224/240

[58] Field of Search ..... 224/222, 224, 224/225, 226, 227, 228, 229, 253, 231, 240, 911, 912, 750, 230, 587, 660; 383/17, 24; 150/107, 134; 180/101, 115; 16/119, 120, 125

[56] References Cited

U.S. PATENT DOCUMENTS

| | | | |
|---|---|---|---|
| 315,303 | 4/1885 | Lambert | 224/253 |
| 843,050 | 2/1907 | Wallerstedt | 224/253 |
| 2,908,306 | 10/1959 | Chorost | 150/134 |
| 3,822,446 | 7/1974 | Silverstein | 150/134 |
| 5,215,237 | 6/1993 | Wu | 224/230 |

FOREIGN PATENT DOCUMENTS

| | | | |
|---|---|---|---|
| 197230 | 2/1920 | Canada | 224/222 |
| 3150565 | 6/1993 | Germany | 150/134 |

*Primary Examiner*—David J. Walczak
*Attorney, Agent, or Firm*—Alvin S. Blum

[57] ABSTRACT

A holder for valuables includes a thin flat container body (1) with one or more compartments with an open top edge and a closure flap (5) extending from a back panel and fastening onto a front panel. One or more elongate narrow strips of material (11) each have a first end secured to the upper portion of the back panel. A second end of each strip terminates in a belt loop (14) for threading onto a belt worn on trousers or skirt. The distance (20) between the loop and the container body of each strip is greater than the height (21) of the container body. This permits the container body to be moved between a concealed position behind the trousers or skirt and accessible position in front of the trousers or skirt while fastened to the belt without bending the container body or disarranging the clothing. The container body slips past the waistband of the trousers or skirt between concealed and access positions without bending the container body or the contents thereof making it suitable for storing passports, credit cards and the like.

8 Claims, 1 Drawing Sheet

CONCEALED BELT-MOUNTED VALUABLES HOLDER

This is a continuation-in-part of U.S. patent application Ser. No. 08/069,746 filed 1 Jun. 1993, now U.S. Pat. No. 5,337,936 issued Aug. 16, 1994.

TECHNICAL FIELD

This invention relates to concealable holders for valuables carried by a person and more particularly to a holder for money, passports, credit cards and the like that is mounted on the belt of the trousers that can be concealed behind the clothing.

BACKGROUND ART

Money belts are well known. They consist of a closable holder with one or more compartments. They are generally elongate with a belt portion at opposed short ends for wearing around the waist beneath the clothing. This provides a very secure location, not visible to passersby. However, the belt directly against the body may be uncomfortable. Furthermore, access is extremely awkward.

More accessible are the pouches that mount directly by a short strap onto the belt that supports the trousers or skirt. These advertise to the passerby exactly where to go for the valuables, so they may be an invitation to crime against the person and property. Furthermore, they bulge outward from the trousers, giving an unattractive appearance. They cannot be readily moved from a concealed position under the trousers to an accessible position in front of the trousers.

DISCLOSURE OF THE INVENTION

It is, accordingly, an object of the invention to provide a holder for valuables that is concealed under the clothing for security and enhanced appearance. It is another object that the holder be readily moved to a position outside of the clothing for ready access to the contents without disarranging the clothing. It is yet another object that the holder be held on the belt of the user to reduce the cost and the awkwardness of a second belt. It is yet another object to provide a thin flat holder that moves or hangs loose behind the trousers or skirt to reduce discomfort and be substantially unnoticeable when in concealed position.

The holder of the invention comprises a thin flat pouch or purse with one or more compartments and a closing flap with fastener. Extending upward from the pouch are elongate strips, spaced apart substantially by the width of the pouch. Each strip terminates in a loop large enough to freely receive the belt. The strips are longer than the height of the pouch. This is necessary for enhanced movement between concealed and access positions without bending the pouch itself. When the pouch contains a passport or credit cards, bending the pouch would be undesirable. A single elongate strip, or three strips may be alternatively provided.

These and other objects, advantages and features of the invention will become more apparent when the detailed description is considered in conjunction with the drawings.

BEST MODE FOR CARRYING OUT THE INVENTION

Figures 1, 2, 3, 4, 5, 6, 7, 8, 9, 10, 11, 12, 13:
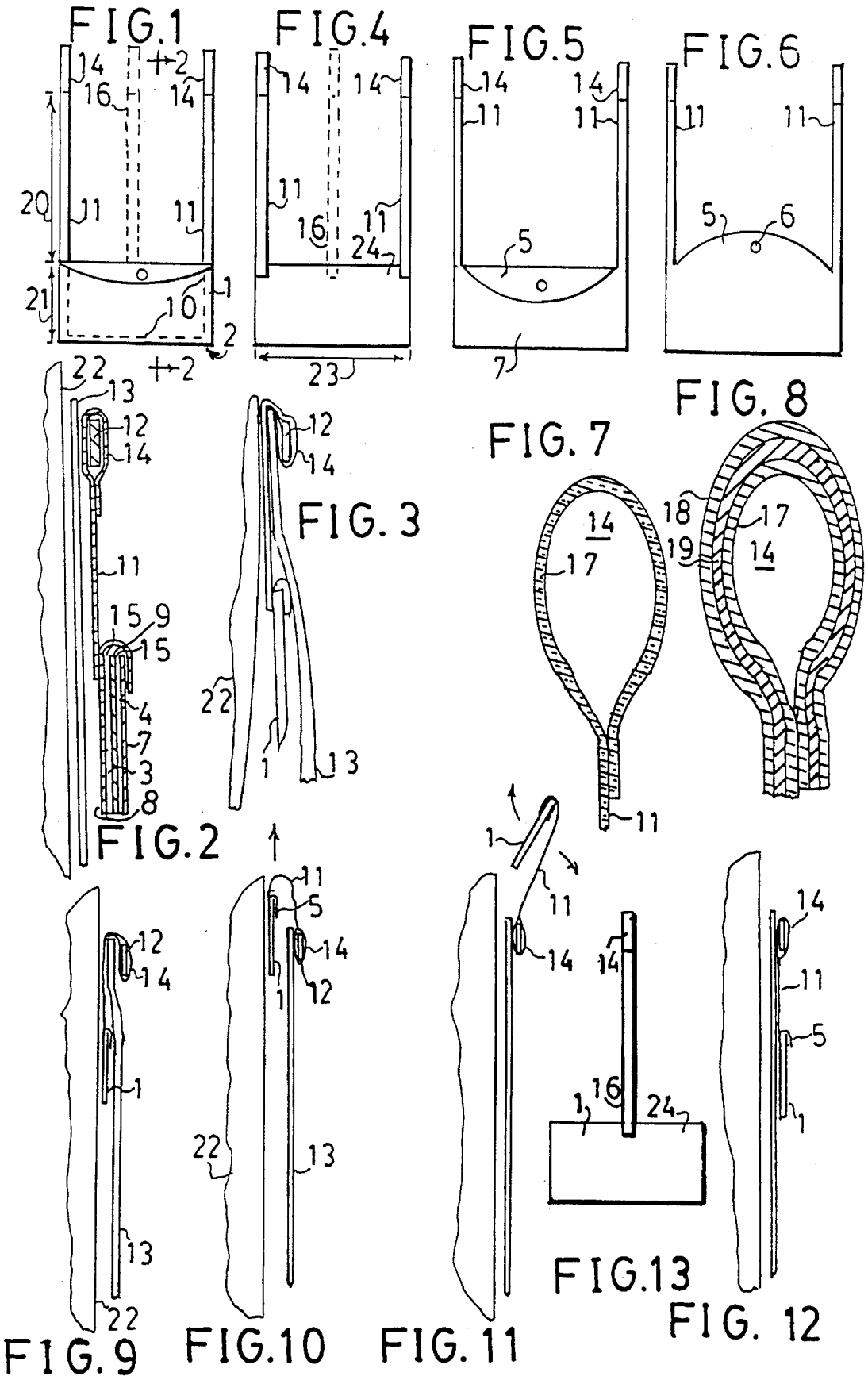
FIG. 1 is a front elevation view of a holder of the invention.
FIG. 2 is a sectional view taken through line 2—2 of FIG. 1.
FIG. 3 is a side elevation view of the holder of FIG. 1.
FIG. 4 is a rear elevation view of the holder of FIG. 1.
FIG. 5 is a front elevation view of an alternative embodiment of the invention.
FIG. 6 is a rear elevation view of the holder of FIG. 5 with Cover flap open.
FIG. 7 is a sectional detail view of a loop of transparent material.
FIG. 8 is a sectional detail view of a loop with a reinforcing wire.
FIG. 9 is a diagrammatic view of the device in the concealed mode of operation.
FIG. 10 is a diagrammatic view of the device being lifted up from the concealed mode.
FIG. 11 is a diagrammatic view of the device having been rotated 180° about the strips.
FIG. 12 is a diagrammatic view of the device having been rotated around the belt another 180° to the access position.
FIG. 13 is a rear elevation view of an alternative embodiment with a single supporting strap.

Referring now first to FIGS. 1–4, the holder 2 of the invention comprises a thin flat container body 1 with two compartments 3, 4 closed with a flap 5 secured by a fastener such as the snap 6, hook and loop, or other fastener well known in the art. The body 1 has a front piece or panel 7, a rear piece or panel 8 and a partition 9 joined together on three sides by stitching 10, cement, heat sealing or other means well known in the art. This arrangement leaves the upper edges 15 open to provide access to the two compartments 3, 4, thus formed. The flap 5 is an extension of the rear panel 8. Connected to the rear panel are two spaced apart strips 11 which terminate in loops 14. These loops 14 are large enough to freely receive the belt 12 that holds up the user's trousers 13. These strips or straps are narrow enough that they look like the belt loops on trousers and the loops found on many belts. Consequently, the passerby would not notice anything suggesting concealed valuables, when the container body 1 is behind the trousers, because only these loops 14 will be visible. Generally the user's body is thickest at the waist, so that the holder hangs in a free space between the leg and the trouser without bulging. The strap length is such that the holder does not interfere with sitting. By spacing the straps apart by at least the vertical height of the holder, the holder resists twisting and the loop spacing is more consistent with the usual clothing appearance. Alternatively, additional straps such as center strap 16 of FIG. 4 may be provided. The straps are shown stitched to the back panel 8 at its upper portion 24.

Alternatively, as shown in FIGS. 5 and 6, the straps 14 may be an integral extension of the rear panel 8. The device may be made of a variety of sheet materials such as leather, fabric or plastic. When made of transparent plastic, the device may be even less visible. FIG. 7 is a sectional view in detail of a loop 14 made of a single layer 17 of transparent sheet material. FIG. 8 shows a sectional view of a detail of a loop 14 made up of a double layer of sheet material 17, 18 with a thin steel cable 19 sandwiched therebetween for further security against cutpurses. Because the holder may be used for plastic credit cards, passports, and other non-foldable items, the free length of the strap 20 should be greater than the vertical height 21 of the holder body to facilitate movement between concealed and accessible positions without undue discomfort.

This is best shown in the diagrams of FIGS. 9–12, in which the container body first hangs between the leg 22 and the trouser 13, concealed with only the loop 14 showing (FIG. 9). The body 1 is lifted out of the concealed mode by either lifting up on the straps or slipping a hand behind the trousers, grasping the body 1 and lifting it upwards. Because the holder is thin and flat, it is easily lifted straight up behind the belt, but the strap length 20 must be great enough so that the container body 1 clears the waistband of the trousers (FIG. 10) with the container body 1 parallel to the trousers. If it were shorter, the user would have to either bend the container body 1 or provide an uncomfortably large gap behind the belt. Credit cards and passports are not readily bendable. When the container body 1 is above the waistband 33 of the trousers, it may then be rotated (FIG. 11) and swung downward to the access position (FIG. 12). In this position, the contents of the compartments are conveniently accessible by simply opening the flap 5. If the holder must be released because both hands are busy, there is no danger that it will be dropped or left behind because it is firmly attached to the user. Container body 1 has a width 23 greater than its vertical height 21 so that it may hold elongate articles such as passports while presenting a minimal vertical height for enhanced operation and for spacing the loops 14 farther apart for better simulation of ordinary spacing apart of belt loops.

FIG. 13 shows an alternative embodiment of the invention in which a single, centrally located, strap 16 with belt loop 14 supports the container body 1.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A holder for valuables mounted on a horizontal belt of a user's trousers or skirt, said holder comprising:

a back panel;

a front panel secured at a lower edge and two side edges thereof to said back panel to form a thin flat container body having a horizontal width that is greater than a vertical height thereof and providing at least one compartment open at an upper edge, said vertical height being the distance between said upper and lower edges and said horizontal width being the distance between said side edges;

a closure means removably closing said upper edge;

an elongate strip of material having a vertical extent, said strip having a first end secured to said back panel at an upper portion thereof and extending vertical upward therefrom, and said strip having a second end terminating in a loop, said loop extending along said vertical extent and defining an aperture disposed transverse to said vertical extent for passing therethrough a horizontal belt, said strip having a distance between said loop and said back panel greater than said vertical height of said container body to thereby permit facile movement of said container body, without bending thereof, between a concealed position underneath said trousers or skirt and an accessible position outside said trousers or skirt while said loop is engaged by said belt on said trousers or skirt.

2. The holder according to claim 1, in which said loop is reinforced by a metal cable.

3. The holder according to claim 1, in which said loop is made of a transparent material.

4. The holder according to claim 1, in which said container body is provided with two compartments.

5. A holder for valuables mountable on a belt or a user's trousers or skirt, said holder comprising:

a back panel;

a front panel secured at three edges thereof to said back panel to form a thin flat container body having a horizontal width that is greater than a vertical height thereof and providing at least one compartment open at an upper edge;

a closure means removably closing said upper edge;

an elongate strip having a long extent, said strip having a first end secured to an outer surface of said back panel at an upper portion thereof and said strip at a second end being folded back upon itself to form a loop, said loop defining an aperture disposed transverse to said long extent and adapted for passing therethrough a horizontal belt, said strip having a distance between said loop and said back panel greater than said height of said container body to thereby permit facile movement of said container body, without bending thereof, between a concealed position underneath said trousers or skirt and an accessible position outside said trousers or skirt while said loop is engaged by said belt on said trousers or skirt.

6. The holder according to claim 5, in which said loop is reinforced by a metal cable.

7. The holder according to claim 5, in which said loop is made of a transparent material.

8. The holder according to claim 5, in which said container body is provided with two compartments.

* * * * *